United States Patent [19]

Hilbrink

[11] Patent Number: 4,636,788

[45] Date of Patent: Jan. 13, 1987

[54] FIELD EFFECT DISPLAY SYSTEM USING DRIVE CIRCUITS

[75] Inventor: Johan O. Hilbrink, Cincinnati, Ohio

[73] Assignee: NCR Corporation, Dayton, Ohio

[21] Appl. No.: 572,105

[22] Filed: Jan. 19, 1984

[51] Int. Cl.[4] ..... G09G 3/00

[52] U.S. Cl. ..... 340/804; 340/784; 340/718

[58] Field of Search ..... 340/719, 805, 718, 784, 340/756, 785, 786, 804; 350/332, 333

[56] References Cited

U.S. PATENT DOCUMENTS

| | | | |
|---|---|---|---|
| 3,532,813 | 10/1970 | Lechner | 350/332 |
| 4,065,764 | 12/1977 | Houryu | 340/804 X |
| 4,110,663 | 8/1978 | Miyazaki et al. | 340/805 X |
| 4,237,456 | 12/1980 | Kanatani | 340/719 |
| 4,251,136 | 2/1981 | Miner et al. | 340/719 X |
| 4,297,695 | 10/1981 | Marshall | 340/752 |
| 4,485,379 | 11/1984 | Kinoshita et al. | 340/805 X |

*Primary Examiner*—Marshall M. Curtis
*Assistant Examiner*—Vincent P. Kovaliek
*Attorney, Agent, or Firm*—Albert L. Sessler, Jr.

[57] ABSTRACT

A field effect display system is comprised of a control system and display circuitry. The display circuitry includes an m by n array of field effect picture elements, a plurality of associated diode arrays respectively coupled to the array of field effect picture elements and diode decoder circuitry selectively coupled to the plurality of diode arrays. The control system is controlled by a microcomputer to selectively develop P-column address, N-column address and row address signals in P and N modes of operation. Drive decoder circuitry in the control system is responsive to each row address selectively generated during either a P- or an N-mode of operation for selectively causing an associated one of m drive circuits to enable all of the field effect picture elements in an associated one of m rows of field effect picture elements. During the P-mode of operation, the diode decoder circuitry is selectively responsive to the P-column addresses for selectively causing each of the selectively enabled picture elements to be electrically charged in a first direction through their respective associated diode arrays. During the N-mode of operation, the diode decoder circuitry is selectively responsive to the N-column addresses for selectively causing each of the selectively enabled picture elements to be electrically charged in a second direction through their respective associated diode arrays.

6 Claims, 8 Drawing Figures

P-VOLTAGE TRANSLATOR

N-VOLTAGE TRANSLATOR

FIELD EFFECT DISPLAY SYSTEM USING DRIVE CIRCUITS

BACKGROUND OF THE INVENTION

1. Field of the Invention

The present invention relates to a display apparatus and more particularly to an addressable matrix of field effect picture elements utilizing diode decoding means in conjunction with a plurality of drive circuits to selectively enable the diode switching of voltages for picture element turn-on and charge-retention in each of two modes of operation.

2. Description of the Prior Art

In the prior art, many types of display circuits utilizing diodes have been proposed.

U.S. Pat. No. 3,532,813 discloses a display circuit which includes a matrix of display means. Each display means includes a dynamic scattering nematic liquid crystal cell and a capacitor connected in shunt with the cell through the relatively low impedance of a fast reset pulse generator for the row containing the cell. The addressing means for each display means includes a first diode to charge the cell in the associated display means and a second diode to erase the cell in that display means. A row pulse generator is conneeted to each row of the matrix and a column pulse generator is connected to each column of the matrix. In addition, a reset pulse generator is connected to each row of the matrix. Selection of a liquid crystal cell to light up is accomplished by the coincidence of the row and column pulses for that cell. This enables current to flow through the first diode to cause both dynamic scattering to occur in the liquid crystal cell and the shunt capacitor to become charged. After the coincident row and column pulses for the cell have terminated, the shunt capacitor discharges into the liquid crystal cell, maintaining it in its dynamic scattering condition. Immediately prior to the time that it is desired again to write information into a liquid crystal cell, the reset pulse generator for the row containing that cell is turned on. When turned on, the reset pulse generator applies a negative pulse to each of the second diodes in that row to cause the shunt capacitors and internal capacitances of the cells in that row to discharge through those diodes. After the negative pulse produced by the reset pulse generator terminates, but before the next row and column pulses, the fast reset pulse generator for the row containing the cell applies a pulse across the shunt capacitors and cells in that row to turn off the cells in that row.

U.S. Pat. No. 4,065,764 discloses a liquid crystal display device which comprises mutually insulated numeric segment electrodes for forming numeric characters, mutually insulated digit segment electrodes opposed to the numeric segment electrodes, liquid crystal interposed between the numeric segment electrodes and the digit segment electrodes, switching elements such as diodes selectively coupled to the digit segment electrodes and a driving circuit operable in accordance with digit signals and numeric signals to drive the segments in the liquid crystal display device in a time division multiplex manner. The diodes connected to the digit segment electrodes operate to prevent undesired crosstalk between the segments as the liquid crystal display device is driven.

U.S. Pat. No. 4,297,695 discloses an electrochromic display device comprised of a matrix of column lines and row lines. The matrix is divided into submatrices, each submatrix being defined by a pair of column lines which intersect with a pair of row lines to form four points at the four intersections in the submatrix. Each individual point in the matrix is addressable to produce a local color change in the electrochromic material of the device by sequentially applying expose and develop pulses to that point. To build up an image of graphic information in the display device, short expose pulses are applied via diodes to associated pairs of column and row lines to only those submatrices in which a particular point is to be addressed, and then longer develop pulses are applied via diodes to individual columns and individual rows to the point in each of the exposed submatrices. This procedure is repeated for each of the remaining points in the selected submatrices, thereby covering all of the other desired corresponding points in the submatrices to complete the image. For a matrix comprised of a set of 5 by 7 submatrices, this procedure would be performed 35 times.

SUMMARY OF THE INVENTION

According to the present invention, there is provided a display system comprising:

an array of display means, each of said display means including a field effect picture element having first and second inputs and a diode array coupled to the first input;

control means for selectively generating first, second and third signals;

drive decoder means coupled to said second inputs of said field effect picture elements and being selectively responsive to said third signals for applying enabling signals to selected ones of said field effect picture elements to selectively enable said selected ones of said field effect picture elements during each of said first and second modes of operation; and diode decoder means coupled to said diode arrays and being resonsive to said first signals for selectively enabling said selectively enabled picture elements to be turned on by being electrically charged in a first direction through their respective associated said diode arrays during said first mode of operation and to said second signals for selectively enabling said selectively enabled picture elements to be turned on by being electrically charged in a second direction through their respective associated diode arrays during said second mode of operation.

It is, therefore, an object of this invention to provide a display system for the selective diode switching of voltages to selected capacitive memories in a twisted nematic liquid crystal display.

Another object of this invention is to provide a display system in which drive circuits and diode decoders are selectively utilized to drive a field effect liquid crystal material to provide a display on an array of field effect picture elements.

Another object of this invention is to provide a display system for selectively displaying alphanumeric characters on a display comprised of an array of field effect picture elements.

Another object of this invention is to provide a display system which selectively utilizes drive circuits for row selection and diode decoders for controlling the diode switching of voltages to preselected picture elements in a selected row of a display comprised of an array of field effect picture elements.

Another object of this invention is to provide a display system which selectively displays alphanumeric characters on a twisted nematic liquid crystal display by using the combination of an associated one of a plurality of drive circuits and an associated set of diodes as a picture element selection means when a picture element is being addressed and by using that set of diodes to retain the charge in the internal capacitance of that picture element when that picture element is not being addressed.

A further object of this invention is to provide a field effect liquid crystal display system which utilizes an associated drive circuit and an associated array of diodes to selectively write and retain an electrical charge in either of two directions across selected picture elements in an array of picture elements.

BRIEF DESCRIPTION OF THE DRAWINGS

These and other objects, features and advantages of the invention, as well as the invention itself, will become more apparent to those skilled in the art in the light of the following detailed description taken in consideration with the accompanying drawings wherein.

DESCRIPTION OF THE PREFERRED EMBODIMENT

It should be noted at this time that, throughout this description of the preferred embodiment, the presence of a slash (/) following either a symbol or an acronym represents the logical inversion of that symbol or acronym.

Figure 1:
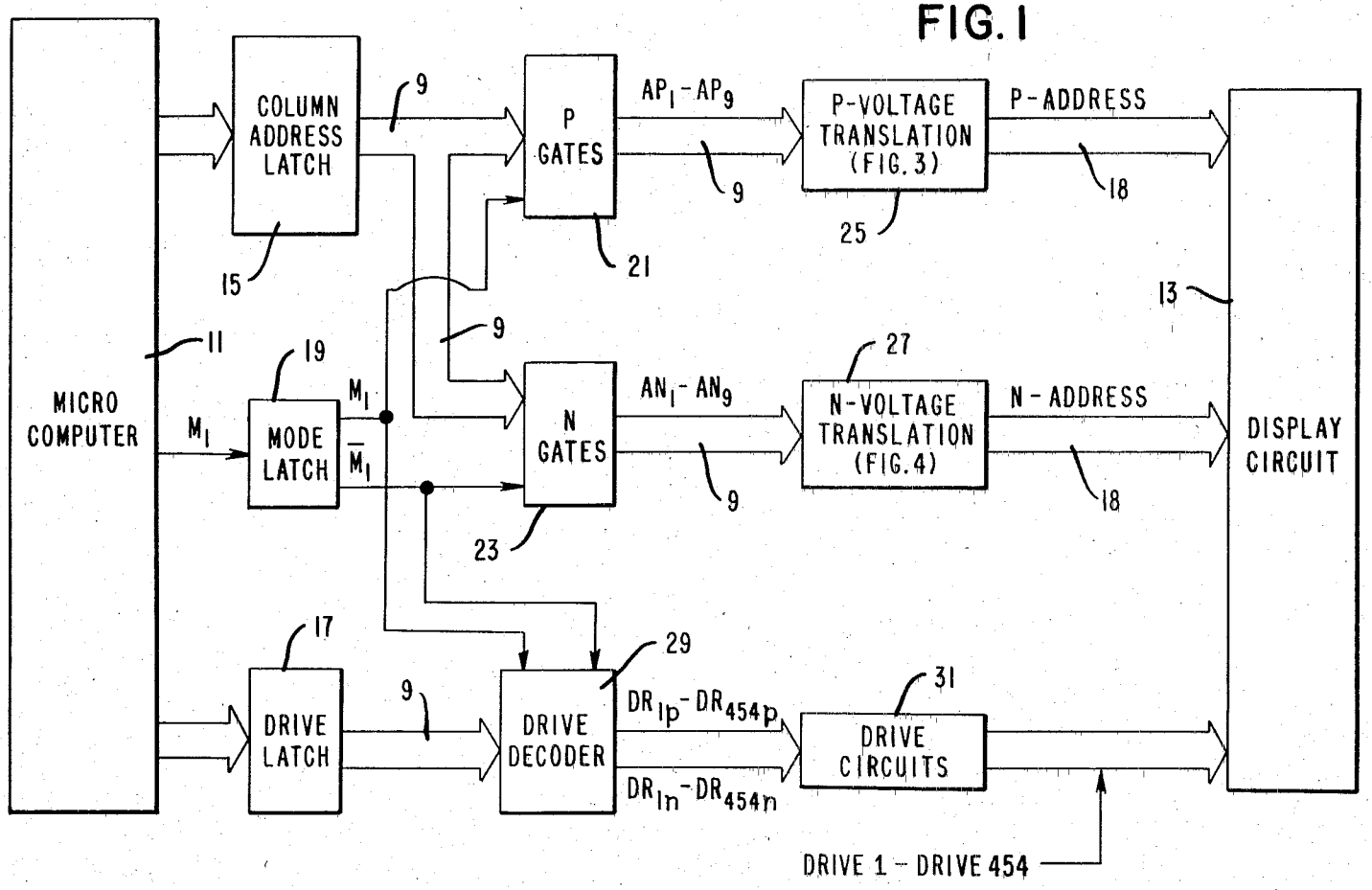
FIG. 1 is a schematic block diagram of a preferred embodiment of the invention.

Referring now to the drawings, FIG. 1 discloses a schematic block diagram of a preferred embodiment of the invention. Basically, the invention is a display system which utilizes a microprocessor or microcomputer 11 to supply signals via intermediate circuitry to drive a field effect material in a display circuit 13 to provide a matrix display of picture elements or pixels in first (P) and second (N) modes of operation. In the context of the present invention a field effect material is a material that changes its reflective characteristics under the influence of an electrical field.

Although the display circuit 13 will be described in this specification as displaying alphanumeric characters, it should be understood that the invention could be utilized to provide a flat television screen or any other desired readout. For purposes of this description, the microcomputer 11 can be an Intel 8051 microcomputer and the field effect material in the display circuit 13 can be a twisted nematic liquid crystal material.

Microcomputer 11 is programmed to sequentially develop the desired addresses of the display picture elements or pixels to be turned on in sequence, as well as the mode of operation signal $M_1$, to form the desired display on the display circuit 13. The system selects only one picture element at a time to be turned on. As a result, the column address of a given picture element to be turned on in the display circuit 13 is selectively latched into column address latch 15 and the row address of that given picture element is selectively latched into drive latch 17. The mode of operation signal $M_1$, which is a binary "1" or "0" signal, is latched into mode latch 19 to enable mode latch 19 to output $M_1$ and its complement $M_1/$. Programming a microcomputer, such as an Intel 8051 microcomputer, is well known to those skilled in the art of programming.

Column address latch 15 and drive latch 17 may be implemented by means of Texas Instruments latches having part number SN74ALS273, while mode latch 19 may be implemented by means of a Texas Instruments latch having part number SN74ALS109.

For purposes of this description it will now be assumed that the display circuit 13 is comprised of an M by N array or matrix of picture elements or pixels to display 80 characters in each of 50 text lines. In this case, M and N can be 454 and 481, respectively. In this event, any given picture element or pixel in that M by N matrix can be addressed by a 9-bit column address and a 9-bit row address. Consequently, an exemplary 9-bit column address is latched into column address latch 15 and an exemplary 9-bit row address is latched into drive latch 17.

The 9-bit column address in latch 15 is applied to P-gates 21 and to N-gates 23. Each of the P-gates 21 and N-gates 23 in this description may comprise 9 NAND gates (not shown) for respectively receiving at first inputs (not shown) the 9 bits in the column address. The $M_1$ bit or signal from mode latch 19 is applied to each of second inputs (not shown) of the 9 NAND gates in P-gates 21. Similarly, the $M_1/$ bit or signal from mode latch 19 is applied to each of second inputs (not shown) of the 9 NAND gates in N-gates 23.

During the P-mode of operation, $M_1$ is a binary 1 and $M_1/$ is a binary 0. A binary 1 state $M_1$ enables P-gates 21 to develop P-address bits $AP_1$–$AP_9$, while a binary 0 state $M_1/$ disables N-gates 23 causing N-gates 23 to develop a binary 111111111 output. Similarly, during the N-mode of operation, $M_1$ is a binary 0 and $M_1/$ is a binary 1. A binary 0 state $M_1$ disables P-gates 21, causing P-gates 21 to develop a binary 111111111 output. A binary 1 state $M_1/$ enables N-gates 23 to develop N-address bits $AN_1$–$AN_9$.

The $AP_1$–$AP_9$ bits from P-gates 21 are applied to P-voltage translation circuit 24. Similarly, the $AN_1$–$AN_9$ bits from N-gates 23 are applied to N-voltage translation circuit 27. The voltage translation circuits 25 and 27 function to respectively translate the $AP_1$–$AP_9$ bits and the $AN_1$–$AN_9$ bits from integrated logic circuit voltages (0 volts or +5 volts) to the voltages required to operate the display circuit 13. The voltage translated P-address outputs of translation circuit 25 and N-address outputs of translation circuit 27 are then applied to the display circuit 13. The P-address outputs of translation circuit 25 sequentially supply the column addresses for the picture elements to be turned on in the display circuit 13 during the P-mode of operation. On the other hand, the N-address outputs of translation circuit 27 sequentially supply the column addresses for the picture elements to be turned on in the display circuit 13 during the N-mode of operation.

The row address, that was latched into drive latch 17 by the microcomputer 11, is decoded by drive decoder 29. The drive decoder 29 can be implemented by means of Texas Instruments decoders, having part number SN74ALS138, to provide 454 P-output lines $DR_{1p}$–$DR_{454p}$ and 454 N-output lines $DR_{1n}$–$DR_{454n}$. The $M_1$ and $M_1$/ bits from mode latch 19 are applied to the drive decoder 29 to control the operation of the drive decoder during the P- and N-modes of operation. During the P-mode of operation the $DR_{1p}$–$DR_{454p}$ lines are active and the $DR_{1n}$–$DR_{454n}$ lines are inactive, while during the N-mode of operation the $DR_{1n}$–$DR_{454n}$ lines are active and the $DR_{1p}$–$DR_{454p}$ lines are inactive. The row address from drive latch 17 causes drive decoder 29 to select one of its P-output lines $DR_{1p}$–$DR_{454p}$ during the P-mode of operation and one of its N-output lines $DR_{1n}$–$DR_{454n}$ during the N-mode of operation to drive an associated one of drive circuits 31. The driven one of the drive circuits 31 then applies to an associated one of output DRIVE 1–DRIVE 454 lines the proper voltage to enable the row of the picture element that is to be turned on.

The alphanumeric display in the display circuit 13 comprises a number of display text lines and a number of character positions on each line. Each character position allows a character to be displayed by selectively turning on pixels arranged in, for example, a 5 by 7 dot submatrix. Each pixel in the display circuit 13 can be addressed by means of the P-address outputs and an associated one of the drive lines (DRIVE 1–DRIVE 454) during the P-mode of operation (when $M_1=1$) or by the N-address outputs and an associated one of the drive lines during the N-mode of operation (when $M_1=0$).

In the operation of the system of FIG. 1, the microcomputer 11 stores two types of display information. It stores the ASCII codes for the alphanumeric characters to be displayed, and it stores in an internal character ROM (not shown) the pattern of pixels or picture elements for each of those characters. For example, the ASCII code for the letter A is 301 (11000001), while the pattern of pixels that make up the display of the letter A in the display circuit 13 is shown in the exemplary 5 by 7 dot submatrix 25 of FIG. 2.

Figure 2:
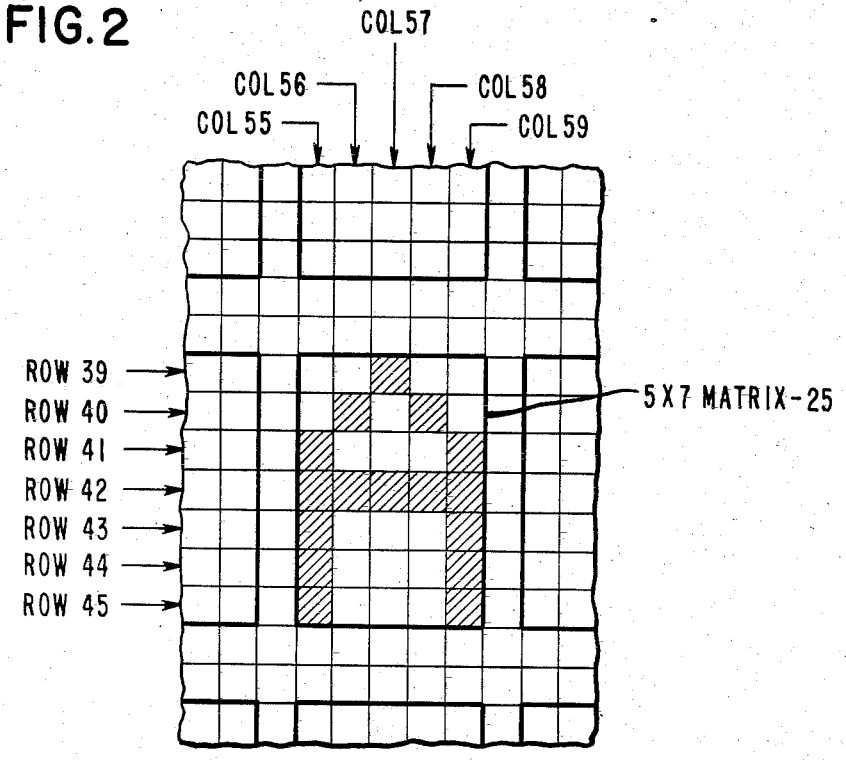
FIG. 2 is a graphical representation of a 5 by 7 pixel submatrix which can be used in the display circuit of FIG. 1.

For purposes of illustration, FIG. 2 shows adjacent character positions enclosed in dark lines, with a one-pixel spacing between adjacent horizontal character positions and a two-pixel spacing between adjacent vertical character positions.

Assume that, in the execution of a program to display alphanumeric characters on the display circuit 13, the microcomputer 11 is to display the character A in the 10th character position of display text line 5, shown as submatrix 25 in FIG. 2. Essentially, to write the character A into the 5 by 7 dot submatrix 25, each of the cross-hatched pixels in the submatrix 25 of FIG. 2 is turned on (made "black") in the pattern of the character A. To accomplish this, the microcomputer 11 computes the addresses for the pixels that make up the character A for the 10th character position on display text line 5 and then it generates the sequence of the addresses for the pixels that need to be turned on.

As indicated before, programming a microcomputer, such as an Intel 8051 microcomputer, to accomplish the above-described computations is well known to those skilled in the art of programming.

Initially the microcomputer 11 locates the address of the beginning pixel in the upper left-hand corner of the 10th character position on display text line 5. This beginning pixel is located at address 39, 55 which is the 39th pixel down from the top of the display in the display circuit 13 and the 55th pixel horizontally from the left. The microcomputer 11 then determines from the pattern for the character A in its internal character ROM that the third pixel in the first line of the character A needs to be turned on. So the microcomputer 11 generates the associated address 39, 57 (row 39, column 57) for that third pixel and selectively strobes that address 39, 57 into the drive latch 17 and column address latch 15. These address signals along with the mode signals $M_1$ and $M_1$/, as discussed above, cause the voltage translation circuits 25 and 27 and the drive circuits 31 to provide the proper voltages to the display circuit 13 to turn on the pixel located at address 39, 57 (row 39, column 57). After turning on the pixel at address 39, 57, the microcomputer 11 determines that there are no more pixels on the top line of the character A in the character ROM that need to be displayed. In the same manner, the microcomputer 11 then sequentially develops addresses 40, 56 and 40, 58 for the second line in the character A in the character ROM; 41, 55 and 41, 59 for the third line in the character A in the character ROM; and so on until addresses have been generated for the remaining picture elements to be turned on in the display circuit 13 for the character A in the submatrix 25. After all of the cross-hatched pixels in submatrix 25 of FIG. 2 have been selectively turned on, the character A is displayed.

Figure 3:
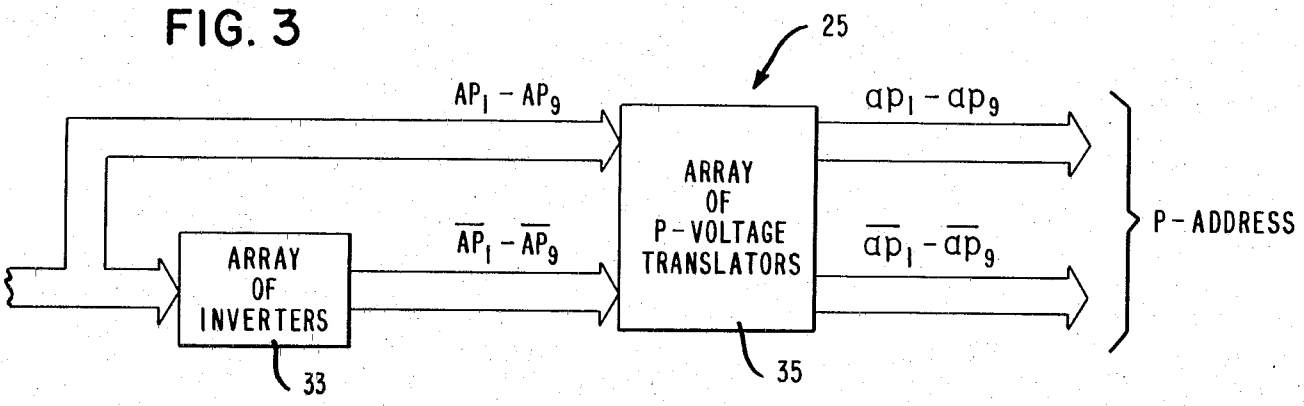
FIG. 3 is a schematic block diagram of the P-voltage translation circuit of FIG. 1.

Referring now to FIG. 3, the P-voltage translation circuit 25 is shown in greater detail. In the P-voltage translation circuit 25, the $AP_1$–$AP_9$ bits are logically inverted by an array of inverters 33 to develop complementary $AP_1$/–$AP_9$/ bits. The $AP_1$–$AP_9$ bits and their complements $AP_1$/–$AP_9$/ are then applied to an array of P-voltage translators 35, which array 35 develops voltage translated P-address signals $ap_1$–$ap_9$ and $ap_1$/–$ap_9$/. These P-address signals are the column address signals for the display circuit 13 during the P-mode of operation.

Figure 4:
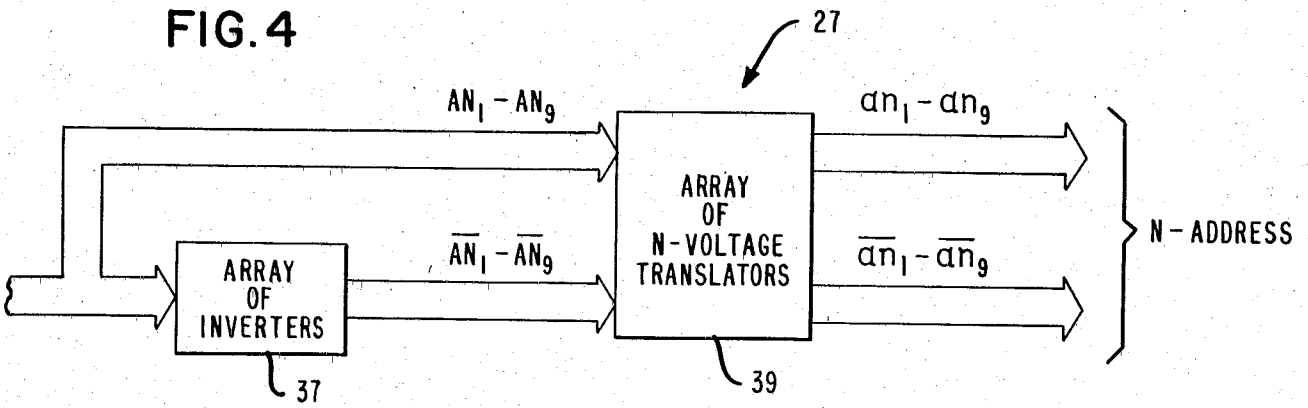
FIG. 4 is a schematic block diagram of the N-voltage translation circuit of FIG. 1.

FIG. 4 illustrates the N-voltage translation circuit 27. In the N-voltage translation circuit 27, the $AN_1$–$AN_9$ bits are logically inverted by an array of inverters 37 to develop complementary $AN_1$/–$AN_9$/ bits. The $AN_1$–$AN_9$ bits and their complements $AN_1$/–$AN_9$/ are then applied to an array of N-voltage translators 39, which array 39 develops voltage translated N-address signals $an_1$–$an_9$ and $an_1$/–$an_9$/. These N-address signals are the column address signals for the display circuit 13 during the N-mode of operation.

Each of the arrays of inverters 33 (FIG. 3) and 37 (FIG. 4) contains nine inverters (not shown), one inverter for each input bit. Similarly, each of the arrays of voltage translators 35 (FIG. 3) and 39 (FIG. 4) contains 18 voltage translators, one voltage translator for each input bit. A P-voltage translator is shown in FIG. 5, while an N-voltage translator is shown in FIG. 6.

Figure 5:
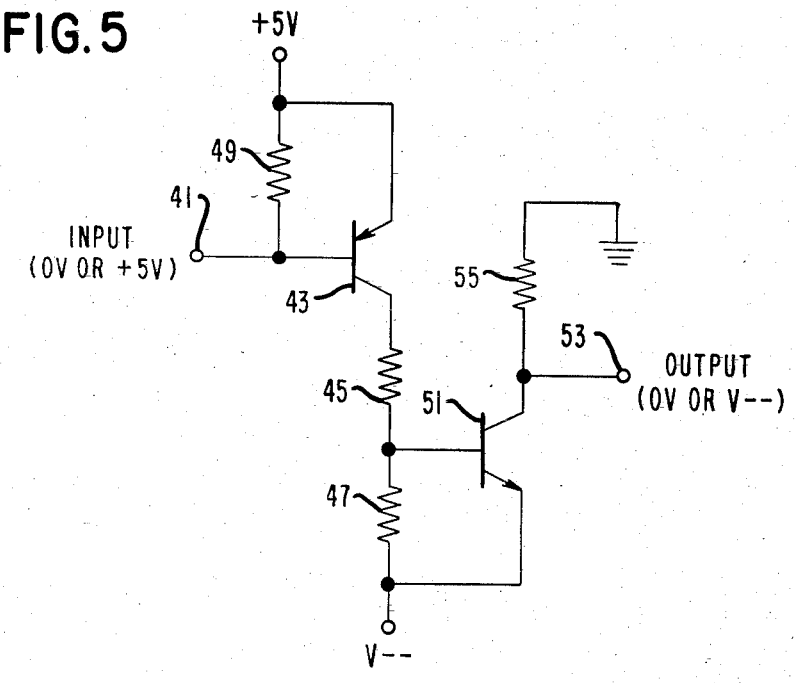
FIG. 5 is a schematic circuit diagram of one of the array of P-voltage translators of FIG. 3.
Figure 6:
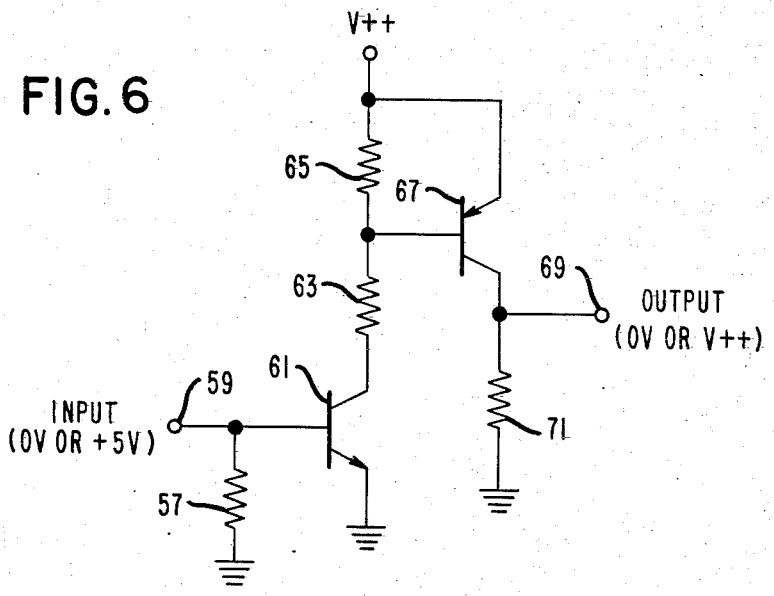
FIG. 6 is a schematic circuit diagram of one of the array of N-voltage translators of FIG. 4.

The P-voltage translator illustrated in FIG. 5 translates an integrated logic circuit low voltage of 0 V (zero volts) to an output drive logic voltage of V– –, and also translates an integrated logic circuit high input voltage of +5 V to an output drive logic voltage of 0 V. An exemplary value for V– – is −10 V, providing a logic swing of 10 V between V– – and 0 V (or ground).

As shown in FIG. 5, an input terminal 41 is connected to the base of PNP transistor 43, which has its emitter returned to +5 V and its collector connected through serially-connected resistors 45 and 47 to V−−. A base resistor 49 is coupled between the base and emitter of the transistor 43. The junction of resistors 45 and 47 is connected to the base of NPN transistor 51 which has its emitter returned to V−−. The collector of transistor 51 is connected directly to output terminal 53 and also through resistor 55 to ground. The output developed at output terminal 53 represents one of the $ap_1$–$ap_9$ and $ap_1$/–$ap_9$/ outputs from the array of P-voltage translators 35 (FIG. 3).

When a low input voltage of 0 V is applied to the input terminal 41, the base-emitter voltage of transistor 43 exceeds the turn-on voltage of transistor 43 and transistor 43 turns on. This causes current to flow from +5 V through the collector-emitter region of transistor 43 and through resistors 45 and 47 to V−−. The resultant voltage drop across resistor 47 is above the base-emitter turn-on voltage of transistor 51. As a result, transistor 51 is turned on, causing an output voltage of V−− to be developed at output terminal 53.

When a high input voltage of +5 V is applied to the input terminal 41, the base-emitter voltage of transistor 43 becomes 0 V, because the emitter of transistor 43 is also at +5 V. As a result, transistor 43 is turned off. When transistor 43 is turned off, no current flows through resistors 45 and 47. In this case, the base-emitter voltage of transistor 51 is below the turn-on voltage of transistor 51. Hence, transistor 51 is turned off. When transistor 51 is turned off, an output voltage of 0 V is developed at output terminal 53.

As shown in FIG. 6, resistor 57 is connected between input terminal 59 and ground. An NPN transistor 61 has its base and emitter connected to terminal 59 and ground, respectively, and its collector coupled through serially-connected resistors 63 and 65 to V++. The junction of resistors 63 and 65 is connected to the base of PNP transistor 67 which has its emitter returned to V++. The collector of transistor 67 is connected directly to output terminal 69 and also through resistor 71 to ground. The output developed at output terminal 69 represents one of the $an_1$–$an_9$ and $an_1$/–$an_9$/ outputs from the array of N-voltage translators 39 (FIG. 4).

When a low input voltage of 0 V is applied to input terminal 59, no current flows through resistor 57. The resultant 0 V drop across resistor 57 is below the base-emitter turn-on voltage of transistor 61. As a result, transistor 61 is turned off. When transistor 61 is turned off, no current flows through resistors 63 and 65. Consequently, the base-emitter voltage of transistor 67 is 0 V and transistor 67 is turned off. When transistor 67 is turned off, no current flows through resistor 71 and therefore an output voltage of 0 V is developed at output terminal 69.

When a high input voltage of +5 V is applied to input terminal 59, the transistor 61 is forward biased into conduction. Current flows from V++ through resistors 65 and 63 and through the transistor 61 to ground. The resultant voltage drop across resistor 65 forward biases transistor 67, turning transistor 67 on. When transistor 67 is turned on, an output voltage of V++ is developed at output terminal 69.

Figure 7:
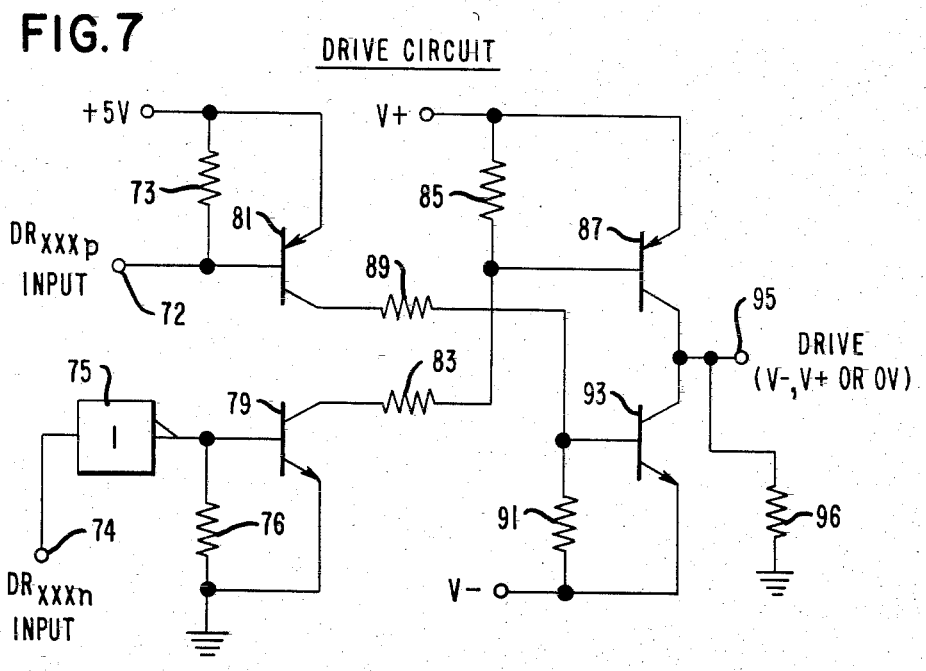
FIG. 7 is a schematic circuit diagram of one of the drive circuits of FIG. 1.

Referring now to FIG. 7, one of the drive circuits 31 (FIG. 1) is illustrated. The drive circuit illustrated in FIG. 7 translates an integrated logic circuit low DR input voltage of 0 V to an output drive logic voltage of V−, and also translates an integrated logic circuit high DR input voltage of +5 V to an output drive logic voltage of V+. Exemplary values for V− and V+ are −5 V and +5 V, respectively, providing a logic swing of 10 V therebetween.

As shown in FIG. 7, one of the 454P-output lines $DR_{1p}$–$DR_{454p}$, designated as $DR_{xxxp}$, is connected to an input terminal 72 which, in turn, is coupled through a resistor 73 to +5 V. An associated one of the N-output lines $DR_{in}$–$DR_{454n}$, designated as $DR_{xxxn}$, is connected to an input terminal 74 which, in turn, is coupled through an inverter 75 and resistor 76 to ground. The XXX in $DR_{xxxp}$ represents the same number as the XXX in $DR_{xxxn}$. For example, if FIG. 7 were the 288th drive circuit in drive circuits 31 (FIG. 1), then output lines $DR_{228p}$ and $DR_{228n}$ from drive decoder 29 (FIG. 1) would be respectively connected to input terminals 72 and 74. The junction of inverter 75 and resistor 76 are connected to the base of an NPN transistor 79 which has its emitter grounded. The input terminal 72 is also connected to the base of a PNP transistor 81 which has its emitter returned to +5 V. The collector of transistor 79 is connected through resistors 83 and 85 to V+. The junction of resistors 83 and 85 is connected to the base of PNP transistor 87 which has its emitter returned to V+. The collector of transistor 81 is connected through resistors 89 and 91 to V−. The junction of resistors 89 and 91 is connected to the base of NPN transistor 93 which has its emitter returned to V−. The collectors of transistors 87 and 93 are connected together at an output terminal 95. Resistor 96 is connected between the output terminal 95 and ground to develop a DRIVE output thereacross. This DRIVE output represents one of the DRIVE 1–DRIVE 454 outputs from drive circuits 31 (FIG. 1).

The drive circuit of FIG. 7 has three different operational modes of operation, namely, the P-mode, N-mode and quiescent mode.

In the P-mode of operation, a low input voltage of 0 V is applied via the $DR_{xxxp}$ line to input terminal 72, while a high input voltage of +5 V is applied via the $DR_{xxxn}$ line to input terminal 74. The high input voltage of +5 V is logically inverted to 0 V by inverter 75. As a result no current flows through resistor 75. The resultant 0 V drop across resistor 75 is below the base-emitter turn-on voltage of transistor 79. As a result, transistor 79 is turned off. When transistor 79 is turned off, no current flows through resistors 85 and 83. Consequently, resistor 85 pulls up the base of transistor 87 above the base-emitter turn-on voltage of transistor 87, turning off transistor 87. On the other hand, the low input voltage of 0 V on input terminal 72 causes the base-emitter voltage of transistor 81 to fall below the base-emitter turn-off voltage of transistor 81. This turns on transistor 81, causing current to flow from +5 V through the collector-emitter region of transistor 81 and through resistors 89 and 91 to V−. The resultant voltage drop across resistor 91 is above the base-emitter turn-on voltage of transistor 93. As a result, transistor 93 is turned on, causing an output voltage of V− to be developed at output terminal 95 during the P-mode of operation.

In the N-mode of operation, a high input voltage of +5 V is applied via the $DR_{xxxp}$ line to input terminal 72, while a low input voltage of 0 V is applied via the $DR_{xxxn}$ line to input terminal 74. When a high input voltage of +5 V is applied to the input terminal 72, no current flows through resistor 73. So the base-emitter voltage of transistor 81 is 0 V and transistor 81 is turned off. When transistor 81 is turned off, no current flows through resistors 89 and 91. In this case, the base-emitter voltage of transistor 93 is below the turn-on voltage of transistor 93. Hence, transistor 93 is turned off. On the other hand, the low input voltage of 0 V on input terminal 74 is logically inverted to a high voltage of +5 V by inverter 75. This +5 V at the output of inverter 75 forward biases the base-emitter region of transistor 79, causing transistor 79 to turn on. When transistor 79 turns on, current flows from V+ through resistors 85 and 83 and through the collector-emitter region of transistor 79 to ground. The resultant voltage drop across resistor 85 forward biases transistor 87, turning on transistor 87. When transistor 87 is turned on, an output voltage of V+ is developed at output terminal 95 during the N-mode of operation.

In the quiescent mode of operation, neither a V− or a V+ output is desired from the drive circuit of FIG. 7 during the P-mode of operation, the N-mode of operation or when the system is in neither of the P- and N-modes of operation. In the quiescent mode of operation, a high input voltage of +5 V is applied via the $DR_{xxxp}$ and $DR_{xxxn}$ lines to input terminals 72 and 74. As explained before, when a high input voltage of +5 V is applied to input terminal 72 both of transistors 81 and 93 are turned off, and when a high input voltage of +5 V is applied to input terminal 74 both of transistors 79 and 87 are turned off. When transistors 87 and 93 are simultaneously turned off, an output voltage of 0 V is developed at output terminal 95.

Figure 8:
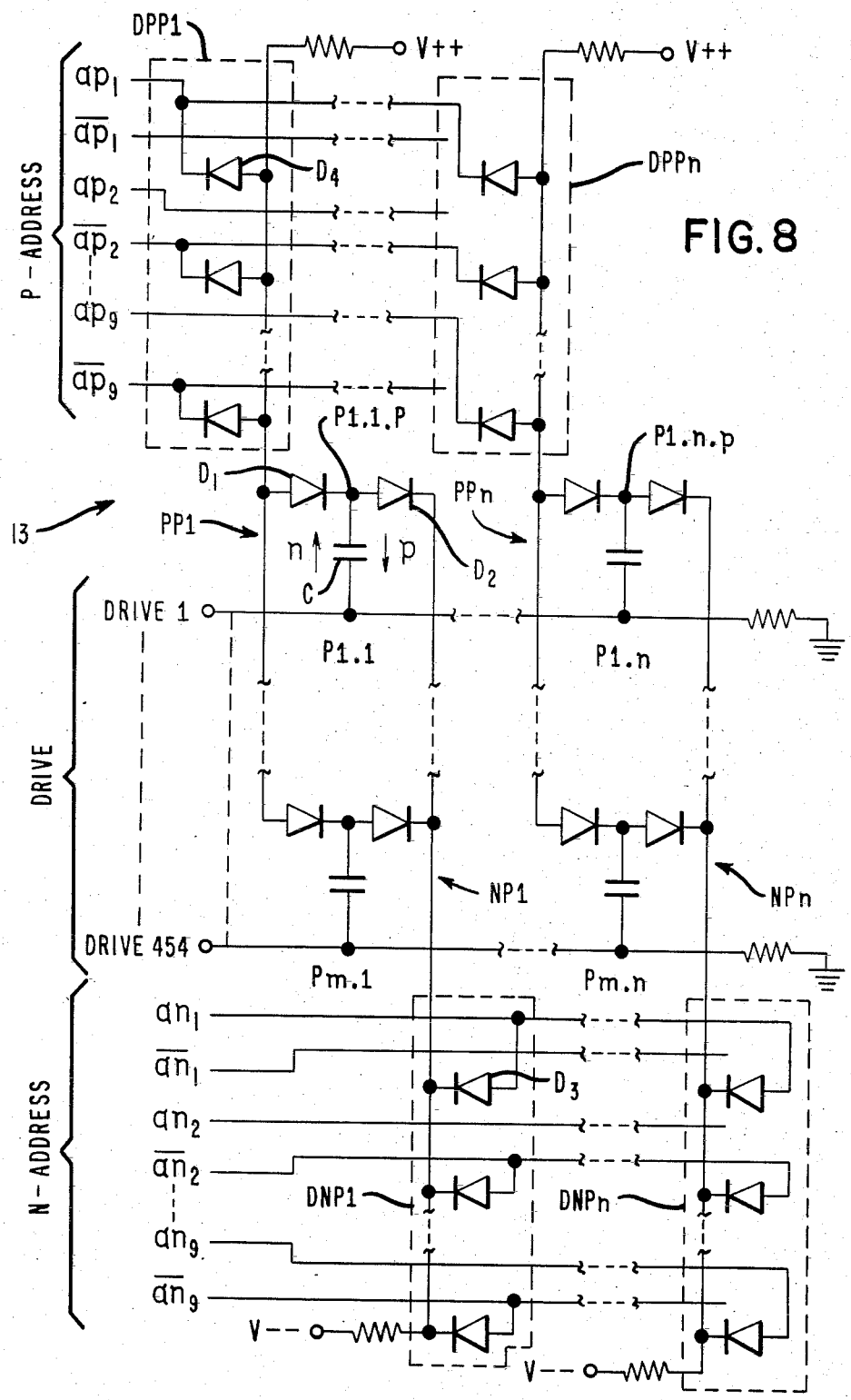
FIG. 8 is a schematic circuit diagram of the display circuit of FIG. 1.

The display circuit 13 of FIG. 1 will now be discussed in detail by referring to FIG. 8. FIG. 8 shows a matrix of field effect display picture elements, such as twisted nematic liquid crystal picture elements or pixels. Although the display circuit 13 will be described as utilizing a twisted nematic liquid crystal material in each of the picture elements, it should be reiterated that the use of any other suitable field effect material in the picture elements is within the purview of the invention. As stated before, a field effect material within the context of the present invention is a material that changes its reflective characteristics under the influence of an electrical field.

The matrix of picture elements or pixels is arranged in N columns identified by subscripts 1 . . . n and M rows identified by subscripts 1 . . . m. For example, $P_{1.1}$–$P_{1.n}$ are the picture elements or pixels in row 1 and $P_{1.n}$–$P_{mn}$ are the picture elements or pixels in column n. In this manner, a pixel P is identified by its row and column positions. For example, pixel $P_{2.7}$ is the pixel P located at the intersection of row 2 and column 7.

Electrically each pixel P in the matrix of pixels operates as a capacitor C due to the internal capacitance of the pixel, with the twisted nematic liquid crystal display material disposed between the plates of the capacitor. When a voltage is applied to the capacitor, the capacitor charges and the resultant electrical field will act on the liquid crystal material in such a manner that the pixel P will turn on. When the charge, and consequently the electrical field, is removed from the capacitor, the liquid crystal material will cause the pixel to turn off. The internal capacitance for pixel $P_{1.1}$ is shown as capacitor C.

In the operation of the system (FIG. 1) only one pixel P is selected by row and column at a time. Only those pixels that require the liquid crystal material to be turned on need to be selected. For an alphanumeric display, the number of pixels needed to represent a character is less than half the number of pixels in a submatrix. FIG. 2 is an illustration of this feature.

It will be recalled that the alphanumeric display in the display circuit 13 comprises a number of display text lines and a number of character position on each line and that each character position allows a character to be displayed by selectively turning on pixels arranged in a 5 by 7 dot submatrix. Each pixel to be turned on during the P-mode of operation is addressed by means of the P-address lines from the P-voltage translation circuit 25 in combination with a selected one of the drive lines DRIVE 1–DRIVE 454 from drive circuits 31. Similarly, during the N-mode of operation, each pixel to be turned on is addressed by means of the N-address lines from the N-voltage translation circuit 27 in combination with a selected one of the drive lines DRIVE 1–DRIVE 454 from drive circuits 31.

By addressing each pixel sequentially, the number of signal lines from the translation circuits 25 and 27 is minimized. For example, the above-described exemplary display circuit 13 having 50 lines of text, with each line having 80 character positions and with each character position employing the 5 by 7 dot or pixel submatrix, requires only 36 column signal lines from the translation circuits 25 and 27 for the P- and N-address lines. These exemplary column signal lines from the voltage translation circuits 25 and 27 are shown in FIG. 8 as P-address lines $ap_1$–$ap_9$ and $ap_1/$–$ap_9/$ and N-address lines $an_1$–$an_9$ and $an_1/$–$an_9/$.

However, to minimize the structure on the display circuit 13, the drive circuits 31 are external thereto. Since, as specified before, there are 454 exemplary rows of pixels in the display circuit 13, there are 454 separate drive circuits in drive circuits 31. As a result, 454 row signal lines are required between drive circuits 31 and the display circuit 13 in order to select one of the 454 rows of pixels at any given time. These exemplary row signal lines from drive circuits 31 are shown in FIG. 8 as drive lines DRIVE 1–DRIVE 454.

Due to the nature of the twisted nematic liquid crystal material used in each pixel, the electrical field that turns a pixel on needs to be periodically reversed in such a manner that the resultant average field across the capacitance of that pixel is zero. Such a periodic reversal of the electrical field across a pixel prevents the diffusion of the twisted nematic liquid crystal material to one plate of the capacitor of that pixel. Arbitrarily, for purposes of this description, one direction of the electrical field is identified by p while the direction of the reverse electrical field is identified by n. The directions of the p and n electrical fields are shown in pixel $P_{1.1}$ in FIG. 8.

The display circuit 13 shown in FIG. 8 uses voltages V++ and V−− from a power supply (not shown). In addition, the display circuit 13 receives V++, V+, 0 V, V− and V−− from the voltage translation circuits 25 and 27 and drive circuits 31 (FIGS. 1 and 3–7) via the P-address lines $ap_1$–$ap_9$ and $ap_1/$–$ap_9/$, the N-address lines $an_1$–$an_9$ and $an_1/$–$an_9/$ and the drive lines DRIVE 1–DRIVE 454, as a function of the address and mode signals outputted by microcomputer 11, as discussed before. For purposes of this description, these voltages utilized by the display circuit 13 are shown symmetrical around ground. However, such symmetry of voltages is not necessary for the operation of the display circuit 13.

The absolute values of the V++, V+, V− and V−− voltages depend on the value of the electrical field required to turn on a specific twisted nematic liquid crystal material and the distance between the equivalent capacitor plates of a pixel. Available twisted nematic liquid crystal materials, in a practical display construction, turn on at approximately 2 to 4 volts. In a display of this nature, the absolute value of each of V− and V+ is about 5 volts. The absolute value of each of V−− and V++ should be higher than the absolute value of each of V− and V+ and sufficient to backbias a diode (to be explained). The absolute value of V−− and V++ can be chosen to be 10 volts.

The display circuit 13 of FIG. 8 is selectively operated in the P- and N-modes of operation. In the P-mode, the capacitors (C) of the pixels that are required to be turned on are selectively charged to provide electrical fields in the p direction. In the N-mode, those capacitors are selectively charged to provide electrical fields in the n direction.

In the P-mode of operation of the display circuit 13, the columns of pixels are selected by the P-address lines. In the N-mode of operation, the columns of pixels are selected by the N-address lines. The P-address and the N-address of the columns are logically identical. As discussed before, the drive latch 17 (FIG. 1) contains the address of the row of the pixel to be turned on and each row of pixels has an associated drive circuit in the drive circuits 31 (FIG. 1) that is selected by the drive decoder 29 as a function of the row address stored in the drive latch 17 (FIG. 1).

In the P-mode of operation, the column address is decoded by diode decoders $DPP_1$–$DPP_n$ selectively connected to the P-address lines $ap_1$–$ap_9$ and $ap_1$/–$ap_9$/, while the row address in latch 17 is decoded by the drive decoder 29 to select one of the drive circuits 31 to enable or energize an associated one of the drive lines DRIVE 1–DRIVE 454. Similarly, in the N-mode of operation, the column address is decoded by diode decoders $DNP_1$–$DNP_n$ selectively connected to the N-address lines $an_1$–$an_9$ and $an_1$/–$an_9$/, while the row address in latch 17 is decoded by the drive decoder 29 to select one of the drive circuits 31 to enable or energize an associated one of the drive lines DRIVE 1–DRIVE 454. For example, if the pixel in column 1 and row 3 is selected to be turned on in the P-mode of operation, the column 1 diode decoder $DPP_1$ will decode the 9-bit P-address lines $ap_1$ and $ap_2$/ through $ap_9$/ (which represent 000000001 in binary notation), while drive decoder 29 will cause drive line DRIVE 3 to be selected.

Each of the P-address lines $ap_1$–$ap_9$ and $ap_1$/–$ap_9$/ can exist in either of two states, TRUE or FALSE, where the voltage for logic TRUE is 0 V and the voltage for logic FALSE is V−−, as shown in FIG. 5. Similarly, each of the N-address lines $an_1$–$an_9$ and $an_1$/–$an_9$/ can exist in either of two states, TRUE or FALSE, where the voltage for logic TRUE is 0 V (ground) and the voltage for logic FALSE is V++.

The drive lines DRIVE 1–DRIVE 454 can exist in any of three states, as explained in relation to FIG. 7. In the quiescent state the associated one of the drive lines DRIVE 1–DRIVE 454 is 0 V. To drive the electrical field across a pixel in the p-direction, the associated one of the drive lines DRIVE 1–DRIVE 454 goes to V− and then returns to the quiescent state. To drive the electrical field across a pixel in the n-direction, the associated one of the drive lines goes to V+ and then returns to the quiescent state.

In order to write a p-field, the address of the column is selected on the P-address lines $ap_1$–$ap_9$ and $ap_1$/–$ap_9$/. For purposes of illustration, the operation of the display circuit 13 of FIG. 8 will be explained by writing a p-field into pixel $P_{1.1}$, where $P_{1.1}$ represents the pixel in row 1, column 1. In order to address column 1 during the P-mode, the P-address lines $ap_1$, $ap_2$/–$ap_9$/ are selected TRUE (0 V). To select row 1 during the P-mode of operation, the microprocesor 11-controlled drive decoder 29 (FIG. 1) causes drive circuits 31 (FIG. 1) to place V− on drive line DRIVE 1.

When $ap_1$, $ap_2$/–$ap_9$/ are all selected TRUE (0 V), all of the diodes in diode decoder $DPP_1$ are forward biased, causing the voltage on P-column line $PP_1$ to go to a voltage one diode drop above 0 V (ground). This causes diode $D_1$, which is connected between node $P_{1.1.p}$ and P-column line $PP_1$ to become forward biased. Due to the voltage drop of the forward biased diode $D_1$, the voltage on node $P_{1.1.p}$ goes to 0 V. All of the other P-column lines $PP_2$–$PP_n$ remain at V−− because at least one of the P-address lines $ap_1$–$ap_9$ and $ap_1$/–$ap_9$/ is FALSE (V−−) and is applied through the associated diode decoders $DPP_2$–$DPP_n$ to those P-column lines $PP_2$–$PP_n$.

The DRIVE lines for those pixels in column 1 where a p-field is to be written are addressed to go to V−. When drive line DRIVE 1 is addressed to go to V−, capacitor C is charged in the p-field direction from P-column line $PP_1$ through the forward biased diode $D_1$ to the drive line DRIVE 1.

Each of the other pixels $P_{1.2}$–$P_{m.n}$ in the M by N matrix of pixels likewise operates as a capacitor C and has two diodes, corresponding to the diodes $D_1$ and $D_2$ of pixel $P_{1.1}$, similarly connected thereto. Because the voltage on all of the other P-column lines $PP_2$–$PP_n$ is V−−, the equivalent $D_1$ diodes connected to these capacitors are backbiased and no other capacitors in a row will charge.

It will be recalled that in the P-mode of operation $M_1$/ is a binary 0 signal. This binary 0 state $M_1$/ signal disables N-gates 23 causing N-gates 23 to develop a binary 111111111 output which, as indicated in FIG. 6, causes N-voltage translation circuit 27 to develop a FALSE output (V++) for each of the N-address bits $an_1$–$an_9$. This causes diode $D_3$ in diode decoder $DNP_1$ to become forward biased and thereby apply the FALSE (V++) signal on N-address line $an_1$ to N-column line $NP_1$. As a result, the voltage on column line $NP_1$ goes to V++, thereby backbiasing diode $D_2$. In a similar manner, because at least one diode in each of the remaining diode decoders $DNP_2$–$DNP_n$ is connected to one of the N-address lines $an_1$–$an_9$, which are all FALSE (V++) during the P-mode of operation, all of the other N-column lines $NP_2$–$NP_n$ are also at V++. Because the voltage on all of the other N-column lines $NP_2$–$NP_n$ is V++, the equivalent $D_2$ diodes connected to the other capacitors (pixels) in the M by N array of pixels are also backbiased.

When the microcomputer 11 (FIG. 1) causes the drive line DRIVE 1 to go from V− to its quiescent state of 0 V, the voltage on node $P_{1.1.p}$ goes to V+ to maintain the same charge across the capacitor C. Both of the diodes $D_1$ and $D_2$ are now backbiased and the capacitor C is charged. The charge on the capacitor C will be retained by these backbiased diodes $D_1$ and $D_2$, causing an electrical field in the p-direction, as indicated in FIG. 8. The 9-bit P-address $ap_1$ and $ap_2$/ through $ap_9$/ for P-column 1 can now be removed or changed, which will then cause the voltage on P-column line $PP_1$ to go to V−− (−10 V).

In order to write an n-field, the address of the column is selected on the N-address lines $an_1$–$an_9$ and $an_1$/–$an_9$/. For purposes of illustration an n-field will now be written into pixel $P_{1.1}$. In order to address column 1 during the N-mode of operation, the N-address lines $an_1$, $an_2$/–$an_9$/ are selected TRUE (0 V). To select row 1 during the N-mode of operation, the microcomputer 11-controlled drive decoder 29 (FIG. 1) causes drive circuits 31 (FIG. 1) to place V+ on drive line DRIVE 1.

When $an_1$, $an_2$/–$an_9$/ are all selected TRUE (0 V), all of the diodes in diode decoder $DNP_1$ are forward biased, causing the voltage on N-column line $NP_1$ to go to a voltage one diode drop above 0 V (ground). This causes diode $D_2$, which is connected between node $P_{1.1.p}$ and N-column line $NP_1$ to become forward biased. Due to the voltage drop of the forward biased diode $D_2$, the voltage on node $P_{1.1.p}$ goes to 0 V. All of the other N-column lines $NP_2$–$NP_n$ remain at V++ because at least one of the N-address lines $an_1$–$an_9$ and $an_1$/–$an_9$/ is FALSE (V++) and is applied through the associated diode decoders $DNP_2$–$DNP_n$ to those N-column lines $NP_2$–$NP_n$.

The DRIVE lines for those pixels in column 1 where an n-field is to be written are addressed to go to V+. When drive line DRIVE 1 is addressed to go to V+, capacitor C is charged in the n-field direction from drive line DRIVE 1 through the forward biased diode $D_2$ to the N-column line $NP_1$.

Because the voltage on all of the other N-column lines $NP_2$–$NP_n$ is V++, the equivalent $D_2$ diodes connected to the other capacitors (pixels) in the M by N matrix of pixels are backbiased and no other capacitors in a row will charge.

It will be recalled that in the N-mode of operation $M_1$ is a binary 0 signal. This binary 0 state $M_1$ signal disables P-gates 21 causing P-gates 21 to develop a binary 111111111 output which, as indicated in FIG. 5, causes P-voltage translation circuit 25 to develop a FALSE output (V−−) for each of the P-address bits $ap_1$–$ap_9$. This causes diode $D_4$ in diode decoder $DPP_1$ to become forward biased and thereby apply the FALSE (V−−) signal on P-address line $ap_1$ to P-column line $PP_1$. As a result, the voltage on column line $PP_1$ goes to V−−, thereby backbiasing diode $D_1$. In a similar manner, because at least one diode in each of the remaining diode decoders $DPP_2$–$DPP_n$ is connected to one of the P-address lines $ap_1$–$ap_9$, which are all FALSE (V−−) during the N-mode of operation, all of the other P-column lines $PP_2$–$PP_n$ are also at V−−. Because the voltage on all of the other P-column lines $PP_2$–$PP_n$ is V−−, the equivalent $D_1$ diodes connected to the other capacitors (pixels) in the M by N array of pixels are also backbiased.

When the microcomputer 11 (FIG. 1) causes the drive line DRIVE 1 to go from V+ to its quiescent state of 0 V, the voltage on node $P_{1.1.p}$ goes to V− to maintain the same charge across the capacitor C. Both of the diodes $D_1$ and $D_2$ are now backbiased and the capacitor C is charged. The charge on the capacitor C will be retained by these backbiased diodes $D_1$ and $D_2$, causing an electrical field in the n-direction, as indicated in FIG. 8. The N-address $an_1$, $an_2$/–$an_9$/ for N-column 1 can now be removed or changed, which will then cause the voltage on N-column line $NP_1$ to go to V++ (+10 V).

The drive lines DRIVE 1–DRIVE 454 can be operated simultaneously or sequentially. A sequential operation of the drive lines DRIVE 1–DRIVE 454 can be performed under control of the microcomputer 11 by the sequential output of row addresses to the drive latch 17. The timing for this operation is controlled by the microcomputer 11. This reduces the complexity of the drive circuitry. If the drive lines DRIVE 1–DRIVE 454 are operated simultaneously additional circuitry would be required in FIG. 1.

Each of the pixels in the M by N matrix of display circuit 13 can be selected by the address of its column position and address of its row position in the matrix by means of the P-address column lines $ap_1$–$ap_9$ and $ap_1$/–$ap_9$/ and an associated one of the drive lines DRIVE 1–DRIVE 454 during the P-mode of operation and by means of the N-address column lines $an_1$–$an_9$ and $an_1$/–$an_9$/ and an associated one of the drive lines DRIVE 1–DRIVE 454 during the N-mode of operation. In this manner, because of the nature of the twisted nematic liquid crystal material, all of the pixels forming the desired characters in the display circuit 13 can be alternately turned on in sequence first by electrical fields in the direction of one of the p- and n-fields and then by electrical fields in the direction of the other one of the p- and n-fields.

It should be noted that the diodes $D_1$ and $D_2$ are located on one plate of the internal capacitance of the pixel $P_{1.1}$. The equivalent diodes $D_1$ and $D_2$ for each of the remaining pixels in the M by N matrix of pixels are likewise located on the same plate of the internal capacitance of an associated one of the pixels. As mentioned before, the twisted nematic liquid crystal material (not shown) is interposed between two plates of a suitable material such as glass of the internal capacitor C of each of the pixels. With the display circuit 13 structured in this manner, there are no cross-overs in the interconnections of pixel $P_{1.1}$ and the other pixels in the display circuit 13 to the two groups of diode decoders $DPP_1$–$DPP_n$ and $DNP_1$–$DNP_n$. As a result of this feature, the present invention contemplates using a microelectronics process for manufacturing all of the diodes $D_1$ and $D_2$ associated with each of the pixels in the M by N matrix of pixels, as well as all of the diodes in the two groups of diodes decoders $DPP_1$–$DPP_n$ and $DNP_1$–$DNP_n$ on one of the two glass plates used.

It is contemplated that one structural embodiment of the display circuit 13 will comprise two plates of glass sealed at the edges with twisted nematic liquid crystal material interposed therebetween. First conductor patterns would be etched on the inner surface of each of the glass plates. In addition, diodes, insulating layers and second conductor patterns would be fabricated on the conductor patterns of one of the glass plates. The conductor patterns on one glass plate would be the drive lines DRIVE 1–DRIVE 454, while the two conductor patterns, diodes and insulating layers on the other glass plate would include the diode arrays and diode decoders shown in FIG. 7. All signal and power lines to the display circuit 13 would pass through the sealed portions of the edges of the two glass plates.

The dielectric constant of the twisted nematic liquid crystal material is dependent on the state of the material. The capacitance of the pixel capacitor C increases as the liquid crystal material reacts to the electric field. The increase in the capacitance, at a fixed electrical charge, decreases the voltage, and consequently the electrical field. This non-linear effect can be compensated in either of two ways. First, the capacitor C can be charged to a sufficient level of electrical charge such that, after the liquid crystal material has reacted to that electric field, the remaining electric field is still high enough to retain the liquid crystal material in its turned on condition. This type of operation requires higher voltages, as well as higher diode breakdown voltage characteristics, than are required with the following preferred type of operation.

The preferred type of operation is to charge the capacitor C to a sufficient degree that the twisted nematic liquid crystal material reacts to the electric field. Subsequently, the capacitor C is successively charged a multiplicity of times in the direction of one of the p and n electric fields, before the electric field across the pixel is reversed, so as to have the pixel display a gray scale value dependent upon the number of times the pixel is charged. This preferred type of operation reduces the requirements for voltage, as well as the requirements for the breakdown voltage characteristics of the diodes. Additionally, with a suitable twisted nematic liquid crystal material, or other suitable field effect material, that reacts proportionally to an electrical field, a gray scale effect can be obtained by charging the capacitor C a smaller number of times than is required to turn the pixel on. In this manner, different gray scale values can achieve the contrasts required of a television display in conformance with the teachings of this invention.

The invention thus provides a display system wherein an addressable array or matrix of field effect picture elements utilize diode decoding means in conjunction with a plurality of drive circuits to selectively enable the diode switching of voltages for picture element turn-on and charge-retention in each of two modes of operation.

While the salient features of the invention have been illustrated and described, it should be readily apparent to those skilled in the art that many changes and modifications can be made in the system of the invention presented without departing from the spirit and true scope of the invention. Accordingly, the present invention should be considered as encompassing all such changes and modifications of the invention that fall within the broad scope of the invention as defined by the appended claims.

What is claimed is:

1. A display system comprising:

an array of display means, each of said display means including a field effect picture element having first and second inputs and a diode array coupled to said first input;

control means for selectively generating first, second and third signals;

drive decoder means coupled to said second inputs of said field effect picture elements and being selectively responsive to said third signals for applying enabling signals to selected ones of said field effect picture elements to selectively enable said selected ones of said field effect picture elements during each of first and second modes of operation; and diode decoder means coupled to said diode arrays and being responsive to said first signals for selectively enabling said selectively enabled picture elements to be turned on by being electrically charged in a first direction through their respective associated said diode arrays during said first mode of operation and to said second signals for selectively enabling said selectively enabled picture elements to be turned on by being electrically charged in a second direction through their respective associated diode arrays during said second mode of operation;

each said diode array comprising first and second diodes coupled between said first terminal and said diode decoding means;

said array of display means comprising m rows and n columns of display means;

said diode decoder means comprising a plurality of first diode decoders respectively coupled to said n columns of display means and being adapted to receive said first signals, each of said first diode decoders being operative to supply a first voltage to each of said first diodes in said diode arrays in its associated column when its column address is contained in said first signals in said first mode of operation; and a plurality of second diode decoders respectively coupled to said n columns of display means and being adapted to receive said second signals, each of said second diode decoders being operative to supply a second voltage to each of said second diodes in said diode arrays in its associated column when its column address is contained in said second signals in said second mode of operation; and said drive decoder means comprising m drive circuits respectively coupled to said m rows of display means, said drive decoder means being responsive to each third signal for enabling a selected one of said drive circuits to supply to all of said second inputs in its associated row of display means said first enabling signals during said first mode of operation and said second enabling signals during said second mode of operation;

each selected said picture element either being responsive to the application of said first voltage to its associated first diode and the application of said first enabling signal to its associated said second input for electrically charging in said first direction to produce a first electrical field across said picture element to turn said picture element on or being responsive to the application of said second voltage to its associated second diode and the application of said second enabling signal to its associated said second input for charging in said second direction to provide a second electrical field across said picture element to turn said picture element on.

2. The display system of claim 1 wherein:

each of the field effect picture elements comprises a liquid crystal material which displays a gray scale value of contrast dependent upon the amplitude of the electrical charge across said picture element.

3. The display system of claim 1 wherein:

each of said field effect picture elements is comprised of a field effect material having optical properties such as to provide a contrast under the influence of an electrical field.

4. The display system of claim 1 wherein:

each of said field effect picture elements comprises a twisted nematic liquid crystal material.

5. The display system of claim 1 wherein said generating means comprises:

a microcomputer for selectively generating column and row addresses and a mode signal; and means responsive to the column and row addresses and the mode signal for selectively developing the first and second address signals and the plurality of mode control signals.

6. A display system comprising:

an array of field effect picture elements;

a plurality of diode arrays respectively coupled to said array of field effect picture elements;

generating means for selectively generating first and second address signals and enabling signals, said enabling signals selectively enabling preselected ones of said field effect picture elements; and diode decoder means selectively coupled to said plurality of diode arrays and being selectively responsive to said first address signals for selectively causing said selectively enabled picture elements to be electrically charged in a first direction through their respective associated diode arrays and to said second address signals for selectively causing said selectively enabled picture elements to be electrically charged in a second direction through their respective associated diode arrays;

said generating means comprising:

a microcomputer for selectively generating column and row addresses and mode signals;

means responsive to the column addresses and the mode signals for selectively generating said first and second address signals; and drive decoder means selectively coupled to said field effect picture elements and being selectively responsive to said row addresses for selectively generating said enabling signals;

said array of field effect picture elements comprising m rows and n columns of said picture elements;

each of said diode arrays including first and second diodes coupled to an associated one of said picture elements;

said diode decoder means comprising: a plurality of first diode decoders coupled to said first diodes and being operative to supply a first voltage to each of said first diodes connected to an associated one of said n columns of picture elements when its column address is contained in said first address signals; and a plurality of second diode decoders coupled to said second diodes and being operative to supply a second voltage to each of said second diodes connected to said associated one of said n columns of picture elements when its column address is contained in said second address signals; and said drive decoder means comprising m drive circuits respectively coupled to said m rows of picture elements, said drive decoder means being responsive to each row address signal for generating a first enabling signal during a first mode of operation to enable a preselected row of said picture elements;

each enabled picture element either being responsive to the application of said first voltage to its associated said first diode for electrically charging in said first direction through said first diode to produce a first electrical field across said picture element to turn said enabled picture element on or being responsive to the application of said second voltage to its associated said second diode for electrically charging in said second direction through said second diode to produce a second electrical field across said picture element to turn said picture element on.

* * * * *